US006633736B1

(12) United States Patent
Park

(10) Patent No.: US 6,633,736 B1
(45) Date of Patent: Oct. 14, 2003

(54) AUTOMATICALLY VARYING THE TRANSFER VOLTAGE IN AN ELECTROPHOTOGRAPHIC DEVELOPMENT PROCESS BASED ON THE INCOMING PATH OF THE SHEET OF PRINT MEDIA

(75) Inventor: Dong-Hoon Park, Kyungki-do (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 1233 days.

(21) Appl. No.: 08/736,042

(22) Filed: Oct. 21, 1996

(30) Foreign Application Priority Data

Oct. 20, 1995 (KR) ..... 95-36343

(51) Int. Cl.[7] ..... G03G 15/16
(52) U.S. Cl. ..... 399/66
(58) Field of Search ..... 399/391, 393, 399/66, 297, 310, 314, 313; 347/155, 156, 158, 111, 112

(56) References Cited

U.S. PATENT DOCUMENTS

| | | | | |
|---|---|---|---|---|
| 4,349,269 A | * | 9/1982 | Okada | 399/392 X |
| 4,918,489 A | | 4/1990 | Inage et al. | 399/391 |
| 5,073,801 A | | 12/1991 | Haneda et al. | 399/45 |
| 5,130,807 A | | 7/1992 | Tanabe et al. | 358/296 |
| 5,237,378 A | | 8/1993 | McEwen | 399/21 |
| 5,250,999 A | | 10/1993 | Kimura et al. | 399/39 |
| 5,321,485 A | | 6/1994 | Nukaya | 358/401 |
| 5,374,981 A | | 12/1994 | Yamamoto et al. | 347/149 |
| 5,444,524 A | | 8/1995 | Lee | 399/18 |
| 5,450,170 A | * | 9/1995 | Kimizuka et al. | 399/18 |
| 5,455,664 A | | 10/1995 | Ito et al. | 399/313 |
| 5,486,903 A | | 1/1996 | Kanno et al. | 399/49 |
| 5,504,565 A | | 4/1996 | Tomiki et al. | 399/297 |
| 5,530,522 A | | 6/1996 | Tsunemi | 399/66 |
| 5,574,543 A | * | 11/1996 | Sakai et al. | 399/59 |
| 5,809,367 A | * | 9/1998 | Yoo et al. | 399/45 |
| 5,822,651 A | * | 10/1998 | Yim et al. | 399/66 |

FOREIGN PATENT DOCUMENTS

| | | | |
|---|---|---|---|
| JP | 58-017468 | * | 2/1983 |
| JP | 6-083142 | * | 3/1994 |
| JP | 08-146831 | * | 6/1996 |

* cited by examiner

*Primary Examiner*—Quana M. Grainger
(74) *Attorney, Agent, or Firm*—Robert E. Bushnell, Esq.

(57) ABSTRACT

An electrophotographic device that allows a user to produce optimum image density images on a variety of recording medium. The electrophotographic device can sense the path a sheet of recording medium takes when being conveyed to an image control unit. From this information, the electrophotographic device can sense from which one of a plurality of input trays the sheet of recording medium originated from, and then automatically adjust the transfer voltage based on which tray the sheet of recording medium originated from. If the recording medium is fed through the automatic feeder, a first transfer voltage is automatically applied during the printing process. If the sheet of recording medium is inserted through a manual feed unit, a second transfer voltage having a greater magnitude than the first transfer voltage is automatically applied during the printing process. Thus, it is possible to achieve optimum image density for a variety of recording medium having a variety of thicknesses.

18 Claims, 3 Drawing Sheets

AUTOMATICALLY VARYING THE TRANSFER VOLTAGE IN AN ELECTROPHOTOGRAPHIC DEVELOPMENT PROCESS BASED ON THE INCOMING PATH OF THE SHEET OF PRINT MEDIA

CLAIM OF PRIORITY

This application makes reference to, incorporates the same herein, and claims all benefits accruing under 35 U.S.C. §119 arising from an application for automatic Transfer Voltage Changing Method In Accordance With Thickness of Printing Paper earlier filed in the Korean Industrial Property Office on Oct. 20, 1995 and there duly assigned Ser. No. 36343/1995.

FIELD OF THE INVENTION

The present invention relates to an image forming apparatus using an electrophotographic developing method, and more particularly, to a method of automatically changing the transfer voltage depending upon a path of the recording media.

BACKGROUND OF THE INVENTION

In order to achieve optimum image density on a piece of recording media in the electrophotography process, the thickness of the document must be considered. If a thick document, such as a postcard, transparency, envelope or, label is to be printed, the transfer voltage needs to be increased in order to achieve a quality result. Contemporary practice in the art, represented by U.S. Pat. No. 5,486,903 for an Image Forming Apparatus With Paper Thickness Detector to Kanno et al., endeavors to construct an image forming apparatus by using a capacitive thickness detector for the recording medium. The recording medium is passed between the plates of a capacitor biased at a fixed voltage, and the capacitance is then measured. From the value of the measured capacitance, the thickness of the printing medium may be determined. After the thickness of the printing media is determined, memory is consulted to determine the appropriate transfer voltage that needs to be applied to the transfer roller to obtain optimum image density on the printing media. Thus, an appropriate bias voltage is applied in the electrophotographic process depending on the gauged thickness and electrical resistance of the printing media. Additional examples of recent efforts in the art are found in U.S. Pat. No. 5,530,522 for an Image Forming Apparatus With Controlled Transfer Voltage to Tsunerni, U.S. Pat. No. 5,455,664 for an Electrophotographic Printer For Transferring Images on Different Sized Print Medium And Transferring Method Of The Same to Ito et al, U.S. Pat. No. 5,374,981 for an Electrostatic Recording Apparatus Capable of Maintaining Constant Gap Between Flexible Recording Electrodes and Opposite Electrode By Flexible Recording Electrodes to Yamamoto et al., U.S. Pat. No. 5,504,565 for an Image Forming Apparatus Having Transfer Voltage Timing Control to Tomiki et al., and U.S. Pat. No. 5,250,999 for an Image Forming Apparatus Having Transfer Voltage And Process Speed Control to Kimura et al. In Tsunemi '522 and Ito et al. '644, the transfer voltage is adjusted depending on the width of the recording media, in Yamamoto et al. '981 and in Tomiki et al. '565, the transfer voltage is adjusted depending on the thickness and the size of the recording media, while in Kimuranet, et al. '999 the transfer voltage is adjusted according to the type of recording medium.

Other efforts in the art sought to provide electrophotographic copiers that allow for and contain numerous input ports for inserting the recording media. For example, U.S. Pat. No. 5,237,378 for a Copier/Printer Employing a Roll Media Feed Apparatus and Dual Functions Sensors to McEwen discloses a copier/printer that has three inputs to accommodate for three different recording media. Each input has a sensor to detect whether or not that particular recording medium is being conveyed to the printer in order to detect jamming in the photocopying machine. Thus, McEwen '378 uses sensors on each recording medium input feed path to aid in the process of the printing operation.

Another example is found in U.S. Pat. No. 5,530,522 for an Image Forming Apparatus With Controlled Transfer Voltage to Inage et al. which uses an electrophotographic machine containing a plurality of recording medium trays and recording medium conveyer paths that merge into a single conveyer path before entering the printing unit. Inage et al. '489 has a controller which dictates when a sheet of recording medium is to be dispensed, and from which tray the sheet is to be dispensed. The controller decides the sequence and the quantity and the timing for dispensation of the recording medium from each of the plurality of feeding trays. Inage et al. '489 seeks to overcome the situation of having two subsequent sheets of recording medium overlap during the conveying process. Therefore, in Inage et al '489, it is essential to know from which feeding tray each recording sheet originates from so that the timing between each sheet of recording medium does not go awry.

U.S. Pat. No. 5,321,485 for a Printing Apparatus Having Manual Sheet Feeding And Document Reading Capabilities to Nukaya discloses a manual feed electrophotographic printing apparatus containing two paths by which the paper may be transported. In addition, a CPU is connected to the electrophotographic machine. A path selector can be set to either a first position or a second position, where the first position ejects the document and the second position guides the sheet to a printer. If the document is ejected, a sensor senses this ejection and sends a signal to the CPU accordingly. If the document is sent to the printer, another sensor senses the presence of the document in the printer and sends a signal to the CPU. Thus, the electrophotographic operation depends upon signals received from sensors along the path taken by the recording medium. I have found that designs such as those represented by McEwen '378, Inage '489 and Nukaya '485 lack an ability to adjust the transfer voltage based on any of these sensed signals.

U.S. Pat. No. 5,444,524 for a Method and Apparatus For Controlling a Print Engine Of A Page Printing Device to Lee endeavors to control the electrophotographic printing process, but lacks ability to accommodate multiple trays of a recording medium. I have discovered that there is a need for an electrophotographic machine that varies the transfer voltage on the basis of the path taken by the sheet of recording medium. In other words, it is my belief that what is needed is an electrophotographic process that automatically adjusts process parameters on a basis of the tray from which the sheet of recording medium originates, so that optimum image density is achieved.

SUMMARY OF THE INVENTION

Accordingly, it is an object to provide an improved electrophotographic photocopier.

It is another object to provide an electrophotographic photocopying machine that optimizes image density by automatically adjusting the transfer voltage in accordance with the tray or feeding unit from which the sheet of recording medium originates.

It is still another object to sense the path of conveyance of a sheet of recording medium and to adjust the transfer voltage accordingly to achieve optimal image quality.

It is yet another object to provide an engine controller for the electrophotographic process that receives signals from sensors disposed to detect the path of a sheet of recording medium and to generate a representative control signal to a transfer voltage generator based on the representative signals from sensor signals.

These and other objects may be attained according to the principles of the present invention by recognizing that if an electrophotographic, device has both an automatic feeding cassette and a manual feeding tray, it may be possible to print quality images on a variety of recording media by sensing the path of the recording media instead of measuring its thickness. In other words, by being able to detect from which input cassette the recording media originates, the transfer bias may be appropriately adjusted in order to optimize image density and image quality. This may be implemented with a transfer voltage generator that generates a first transfer voltage when a first control signal is received from the engine controller, and outputs a second transfer voltage of a different magnitude than the first transfer voltage when a second control signal is received from the engine controller so that one optimal transfer voltage is applied when the recording medium originates from the manual feeding tray and that a relatively different but nonetheless optimal transfer voltage is applied to the electrophotographic process when the recording medium originates from the automatic feeding cassette.

BRIEF DESCRIPTION OF THE DRAWINGS

A more complete appreciation of the invention, and many of the attendant advantages thereof, will be readily apparent as the same becomes better understood by reference to the following detail description when considered in conjunction with the accompanying drawings in which like reference symbols indicate the same or similar components, wherein.

DETAILED DESCRIPTION OF THE INVENTION

Figure 1:
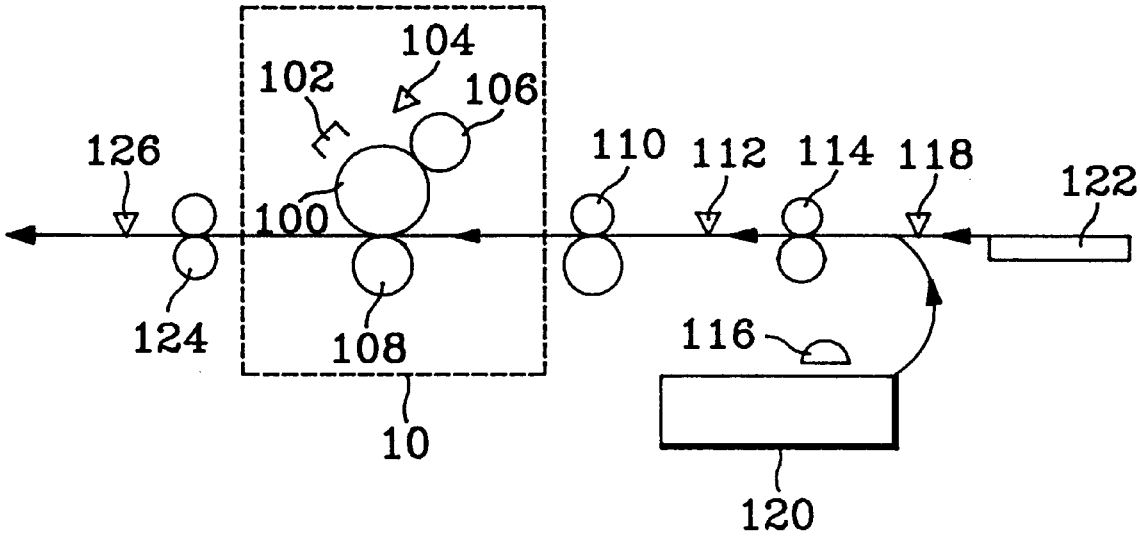
FIG. 1 is a schematic diagram illustrating an engine mechanism of an electrophotographic printer constructed according to the principles of the present invention.

Turning now to the drawings, FIG. 1 shows the engine mechanism of the printer using the electrophotographic developing method, which includes a photosensitive drum 100, a charging unit 102, an exposing unit 104, a developing roller 106, a transfer roller 108, a fixing unit 124, a pick-up roller 116, a feed roller 114, a register-roller 110, a register-sensor 112, an exit sensor 126, a manual paper feeding tray 122, an automatic paper feeding cassette 120, and a manual feed sensor 118. In FIG. 1, charging unit 102 forms a layer having a uniform charge density on the photosensitive drum 100, and exposing unit 104 forms electrostatic latent image on the photosensitive drum 100. The developing unit 106 provides toner that is developed on the electrostatic latent image formed on the photosensitive drum 100, and transfer roller 108 transfers the toner image formed on photosensitive drum 100 to the recording medium. The fixing unit 124 fixes the toner image to the recording medium by applying heat and pressure to the recording medium containing the toner image.

An automatic paper feeding cassette 120 stores printing papers, and pick-up roller 116 picks up the printing papers stored in the automatic paper feeding cassette 120 and then delivers them, one by one, to image forming unit 10. Feed roller 114 feeds the printing paper transferred by the pick-up roller 116 to image forming unit 10, and register-roller 110 arranges the papers fed by feed roller 114. The register-sensor 112 senses the delivery state of the printing paper to sense whether or not a paper jam has occurred, and the manual paper feeding tray 122 transfers recording medium having a larger than standard thickness placed in manual paper feeding tray 122 to image forming unit 10.

Hereinafter, an embodiment of the image forming procedure of the printer using the electrophotographic developing method will be explained with reference to FIGS. 1 and 2. First, if a print command from an external host computer is transmitted to engine controller 144, engine controller 144 drives pick-up roller 116 to feed a sheet of the printing paper stored in the automatic paper feeding cassette 120, while and at the same time, raises the temperature of the fixing unit 124 up to a printing temperature. At this time, feed roller 114 continuously conveys the printing papers to the image forming unit 10, and photosensitive drum 100, charging unit 102, developing roller 106, transfer roller 108, and exposing unit 104 respectively operate in a predetermined time sequence under the control of print control unit 140. The surface of the photosensitive drum 100 is uniformly charged by charging unit 102, and generally has a surface potential between −600 and −800V. If the printing paper fed by feed roller 114 is delivered to the register-roller 110 through the register-sensor 112, a paper sensing signal by register-sensor 112 is input to print control unit 140 through sensor circuit 148. In, the meantime, the register-roller 110 arranges for the delivery of printing papers to image forming unit 10. The print control unit 140, which inputs the paper sensing signal, transmits received image data to exposing unit 104, and then exposing unit 104 exposes light in accordance with transmitted image data onto photosensitive drum 100.

At this time, the exposed portion on the photosensitive drum 100 loses the voltage thereon due to the generation of the light carrier and accordingly, toner can be attached to the exposed portion. Further, the developing roller 106 for delivering toner to the photosensitive drum 100 rotates, while a toner blade regulates the amount and thickness of toner delivered to photosensitive drum 100. At this point, toner is attached on the exposed portion on the photosensitive drum 100 while no toner is attached to the unexposed portions. Thus, a toner image is formed on photosensitive drum 100. Toner attached to the photosensitive drum 100 is transferred to the printing paper by an electric field formed between transfer roller 108 and photosensitive drum 100. Toner transferred onto printing paper is fixed to the printing paper by the heating roller and the pressure roller of fixing unit 124, and then, the printed paper is discharged to the outside of the electrophotographic device.

The foregoing procedure was explained with the standard photocopying paper supplied from the automatic paper feeding cassette. On the other hand, in case of using extra thick recording medium having a higher electrical resistance than standard photocopying papers, the electric field between photosensitive drum 100 and transfer roller 108 is reduced due to the high resistance caused by the extra thickness of the recording medium, resulting in less toner being transferred from photosensitive drum 100 to the thick recording medium, resulting in a reduced image density. To solve the above problem, a sensor 118 is installed on a recording medium conveyor path next to manual recording media feeding tray 122. Sensor 118 is to be triggered whenever a sheet of recording medium is inserted into the manual feeding tray 122 and is conveyed towards image forming unit 10.

Figure 2:
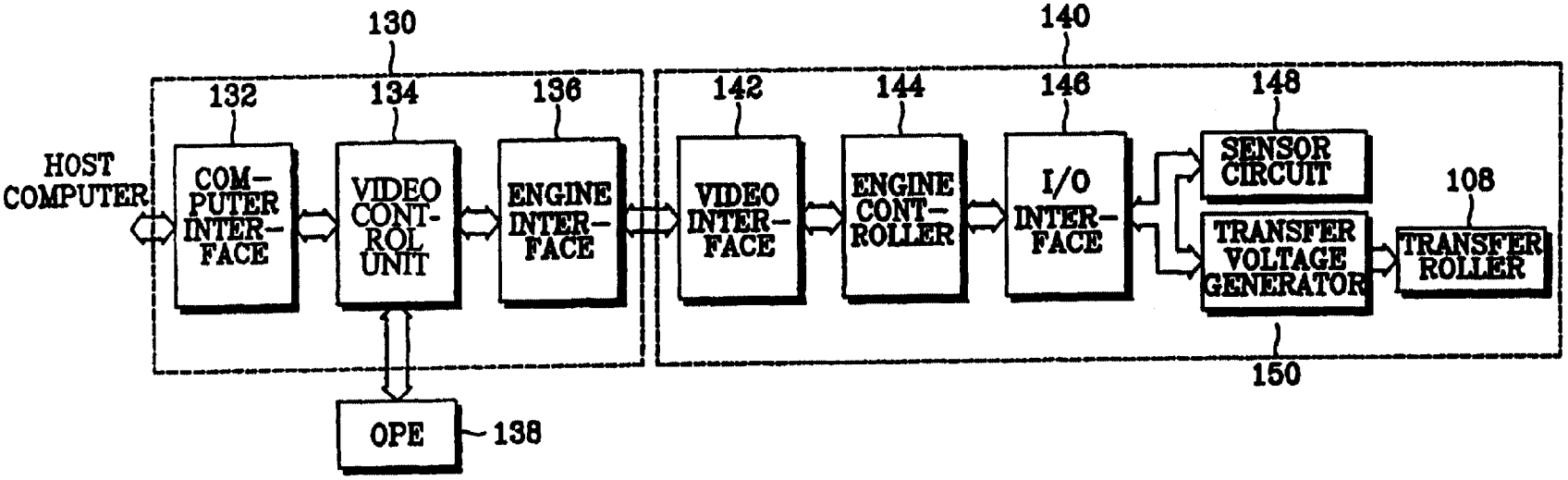
FIG. 2 is a schematic block diagram illustrating a printer of the present invention using an electrophotographic developing method.

FIG. 2 shows a schematic block diagram of a printer according to the present invention connected a print engine unit 140, which is connected to a host computer made up of a video controller 130 and an operating panel OPE 138. The video controller 130 is further made up of a computer interface 132, a video control unit 134 and an engine interface 136. The computer interface unit 132 is connected between a host computer and video control unit 134, and serves to interface an input or an output signal therebetween. Video control unit 134 includes a read-only memory ROM storing a control program as well as a random access memory RAM for temporarily storing various kinds of data to be input from the OPE 138 and from the host computer, and also changes code data received from the computer interface 132 to image data to be processed by the print control unit 140 and to transmit the image to the print control unit 140. The engine interface 136 interfaces the signal to be input or an output transmitted between video control unit 134 and print control engine 140. In addition, the OPE 138 is controlled by the video control unit 134, and includes a plurality of keys for inputting various commands, and a display unit for displaying information according to operations.,of the printer. The print control unit 140 is made up of a video interface 142, an engine controller 144, an input/output interface 146, a sensor circuit 148 and a transfer voltage generator 150, and is connected to the video controller 130. The video interface 142 provides an interface for transmitting and receiving signals between video controller 130 and engine controller 144. Engine controller 144 controls each unit of the print control unit 140 including the transfer voltage generator 150, according to the control of the video controller 130, and then prints image data received from the video controller 130 on the recording medium. Furthermore, the engine controller 144 generates either a first or a second control signal, depending upon whether the manual paper feed sensing signal is received from the sensor circuit 148, and outputs, via transfer voltage generator 150, the appropriate voltage to be applied to transfer roller 108. A first control signal indicates that the recording medium is of standard thickness, and a second control signal indicates that the recording medium has a thickness greater than the standard thickness. The I/O interface 146 is connected between the engine controller 144, the sensor circuit 148 and the transfer voltage generator 150, and serves to interface input/output signal of the engine controller 144. The sensor circuit 148 drives various sensors for sensing the operating state of each unit of the print control unit 140, including the manual feeding sensor 118 and the register-sensor 112, and for sensing the amount off toner used, and provides a recording medium sensing signal to the engine controller 144 according to one embodiment of the present invention. The transfer voltage generator 150 generates a transfer voltage that depends upon whether the first or the second control signal is received from engine controller 144. Transfer voltage generator 150 then applies the appropriate transfer voltage to transfer roller 108. That is, if the first control signal is received by voltage transfer generator 150, transfer voltage generator 150 applies the first voltage to transfer roller 108. This voltage is applied to transfer roller 108, resulting in an electric field intensity across the recording medium resulting in an image of optimum image density on the photocopying paper having a standard thickness. If the second control signal is received by voltage transfer generator 150, voltage transfer generator 150 generates a second transfer voltage which is applied to transfer roller 108. This second voltage is greater than the first voltage and is intended for recording medium having a thickness greater than that of standard printing paper. This results in an electric field intensity across the recording medium so that optimum image density is realized provided the recording medium has a thickness greater than the standard thickness for photocopying paper.

Figure 3:
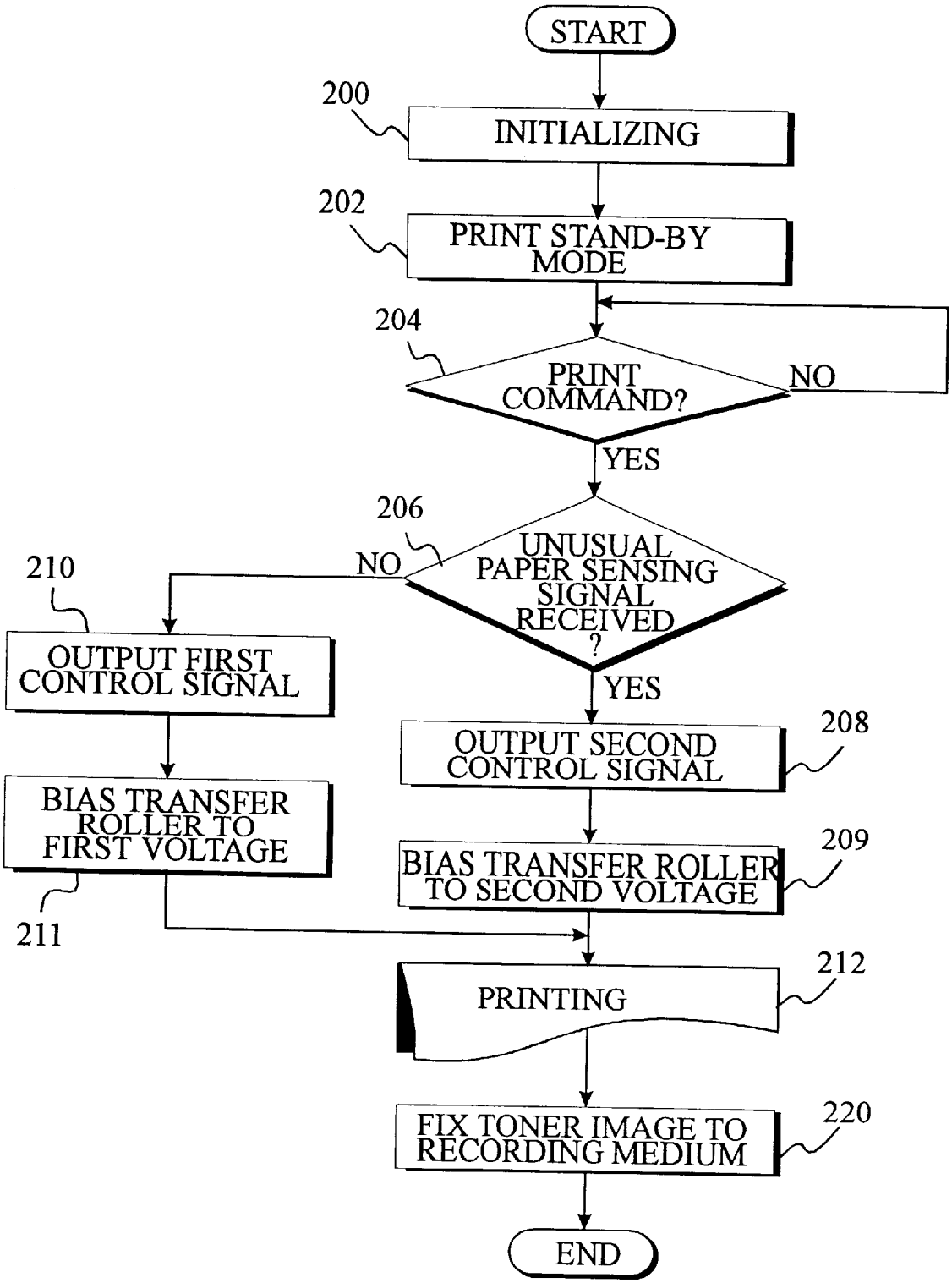
FIG. 3 is a flow chart illustrating operations of sensing the path of manually fed recording media, then automatically changing the transfer voltage according to the sensed path of the recording media.

FIG. 3 shows a flow chart illustrating the control operation for sensing the origin of the recording medium and adjusting the electrophotographic process accordingly. First, if the printer using the electrophotographic process is energized, engine controller 144 initializes each unit of print control unit 140 according to an initializing program in step 200, and then proceeds to step 202 to maintain a print stand-by mode. After that, the engine controller 144 checks whether or not a print command is received from video control unit 134, as in step 204, and if the print command is then received, the control operation proceeds to step 206 to check whether or not the manual feed sensing signal generated from sensor 118 is received.

As a result of this check, if sensor 118 does not sense the conveyance of recording medium from manual feeding tray 122, and if engine controller 144 has already received a print command from video control unit 134, the control operation proceeds to step 210 where engine controller 144 outputs the first control signal to the transfer voltage generator 150. At this point, printing paper of standard thickness is being conveyed from automatic paper feeding cassette 120 and is being delivered to image forming unit 10. Upon receiving a first control signal by transfer voltage generator 150, transfer voltage generator 150 applies a first voltage in step 211 to transfer roller 108, creating a first potential difference in the gap between transfer roller 108 and photosensitive drum 100. Then, in step 212, a sheet of the printing paper of standard thickness is conveyed between transfer roller 108 and photosensitive drum 100, causing the toner image to be transferred from the photosensitive drum 100 onto the printing paper. Lastly, the toner image is fixed to the printing paper in step 220 by fixing unit 124.

On the other hand, if sensor 118 does sense the passage of a sheet of recording medium from manual feeding tray 122, a sheet greater than standard thickness is assumed to be conveyed from manual feeding tray 122, and the control process proceeds to step 208 where engine controller 144 outputs a second control signal to transfer voltage generator 150. Upon receiving the second control signal by transfer voltage generator 150, transfer voltage generator 150 in step 209 applies a second and larger voltage to transfer roller 108 than in the case where the sheet originated from automatic paper feeding cassette 120, creating a larger potential difference in the gap between transfer roller 108 and photosensitive drum 100. Then, in step 212, the sheet of recording medium is conveyed between transfer roller 108 and photosensitive drum 100, causing the toner image to be transferred from photosensitive drum 100 onto the thick recording medium. Lastly, the toner image is fixed onto the recording medium in step 220 by fixing unit 124.

The engine controller 144 controls timing and operation of photosensitive drum 100, charging unit 102, developing roller 106 and exposing unit 104, among other components involved in the process, in a predetermined time sequence in step 212 to perform a printing operation. If the recording medium is fed through the manual paper feeding tray 122 and is detected by sensor 118, a higher voltage is applied to transfer roller 108, and the amount of toner transferred on the recording medium is increased, thereby obtaining optimum image density provided a thicker than standard sheet of recording medium was inserted into manual paper feeding tray 122. In view of an experimental value, in case of using printing paper having a standard thickness, we can obtain optimum image density when transfer voltage is between 0.9 kV and 1.0 kV at a normal temperature and humidity. On the other hand, in case of using the recording medium having a greater than standard thickness, optimum image density is achieved when the transfer voltage is between 1.3 kV and 1.4 kV. Namely, the transfer voltage generated by the second control signal is greater than that generated by the first control signal.

According to the present invention, the manual feed tray 122 is referred to as a manual feed tray for supplying sheets of recording medium one by one as well as a unit (or tray) and for transferring the sheets of recording medium through the manual feed opening. As is apparent from the foregoing, when the recording medium having a larger than standard thickness is fed from manual paper feeding tray 122 to image forming unit 10, a higher transfer voltage is needed than that necessary for transferring toner to the recording medium than for papers having just a standard thickness. This higher transfer voltage is achieved by applying a larger than normal voltage to transfer roller 108, thereby increasing the amount of toner transferred to the thick recording medium. As a result, optimum image density is achieved in all cases, even when the thickness or resistance of the recording medium is greater than normal.

Therefore, it should be understood that the present invention is not limited to the particular embodiment disclosed herein as the best mode contemplated for carrying out the present invention, but rather that the present invention is not limited to the specific embodiment described in this specification except as defined in the appended claims.

What is claimed is:

1. An image informing apparatus using an electrophotographic developing system, comprising:

a photosensitive drum positioned along a path for conveyance of articles of recording media through said system;

a manual paper feed tray attachable to said system while introducing the articles of recording media onto said path via a first avenue;

a cassette associated with said system to introduce other articles of recording media onto said path via a second and different avenue;

a manual paper feed sensor positioned along said first avenue to automatically sense a passage of a sheet of recording media fed from said manual paper feed tray and produce a first signal when the sheet of recording medium is fed into said path from said manual paper feed tray;

an engine controller generating one of a first control signal and a second control signal in dependence upon reception of said first signal sent from said manual paper feed sensor;

a transfer voltage generator generating a first transfer voltage when said first control signal is received from said engine controller and generating a second transfer voltage different from said first transfer voltage when said second control signal is received from said controller;

a transfer unit receiving one of said first and second transfer voltages applied from said transfer voltage generator to transfer an image representing information, formed by toner on said photosensitive drum to said sheet of recording medium;

an operating panel;

a video controller comprising a computer interface a video control unit, said computer interface being connected between a host computer and said video control unit, said computer interface providing an interface for an input and an output signal between said host computer and said video controller, said video controller comprising a memory storing data input from said operating panel and from said host computer and changing code data received from said computer interface into image data; and a print control unit comprising a video interface, said engine controller, an input/output interface, a sensor circuit, and said transfer voltage generator, said video interface providing an interface transmitting and receiving signals between said video controller and said engine controller, said engine controller controlling each unit of the print control unit and initiating printing of image data received from the video controller on said recording media, said input/output interface being connected between said engine controller and both said sensor circuit and said voltage transfer generator, said sensor sensing operational states of said print control unit.

2. The image forming apparatus as defined in claim 1, comprised of said second transfer voltage being greater than said first transfer voltage.

3. A transfer voltage controlling method of an image forming apparatus using an electrophotographic developing system, comprising:

a manual paper feed tray attachable to said system while accommodating manual introduction of articles of recording media onto a path for conveyance of the articles through said system, via a first avenue;

a cassette associated with said system while introducing other articles of recording media onto said path via a second and different avenue;

a paper feed sensor positioned along said first avenue and automatically sensing the recording media fed from said manual paper feed tray as the recording media travels along said first avenue, and producing a responsive signal the recording media travels along said first avenue from said manual paper feed tray toward said path;

an operating panel enabling manual selection of print command;

a video controller generating said print command in response to one of a manual input by a user and a signal generated by a host computer;

an engine controller generating one of a first control signal and a second control signal in dependence upon reception of said responsive signal from said paper feed sensor after said controller has received said print command from said video controller;

a transfer voltage generator generating a first transfer voltage when said first control signal is received from said engine controller and generating a second transfer voltage when said second control signal is received from said engine controller;

a transfer unit receiving one of said first and second transfer voltages applied from said transfer voltage generator to transfer a toner image formed on said photosensitive drum to the recording medium;

said video controller comprising a computer interface and a video control unit, said computer interface being connected between a host computer and said video control unit and providing an interface for of and output signals between said host computer and said video controller, said video controller comprising memory storing data input from said operating panel and from said host computer and converting code data received from said computer interface into image data for a print control unit and said print control unit comprising said engine controller initiating printing of image data received from the video controller on the recording media.

4. The method as defined in claim 3, comprised said second transfer voltage being greater than said first transfer voltage.

5. An electrophotographic device for printing images, comprising:

a photosensitive drum positioned along a path for conveyance of sheets of a recording medium through said device;

a charging unit uniformly charging said photosensitive drum;

an exposing unit disposed to expose said photosensitive drum and to produce a latent image on said photosensitive drum;

a developing unit delivering toner to said photosensitive drum and forming a toner image on said photosensitive drum over said latent image;

a transfer roller positioned to transfer said toner image from said photosensitive drum to a sheet of a recording medium;

a fixing unit fixing said toner image to the recording medium;

a manual feed tray accommodating manual insertion of individual sheets of recording medium onto said path through said electrophotographic device via a first avenue extending between said tray and said path;

an automatic feed tray providing automatic feeding of individual sheets of another recording medium onto said path through said electrophotographic device via a second and different avenue;

a sensing unit automatically generating an output signal indicating detection of a passage of the recording medium from said manual feed tray and along said first avenue;

a transfer voltage generator selectively applying one of a first voltage and a second voltage to said transfer roller;

an operating panel enabling manual selection of a print command;

a video controller generating said print command in response to said manual selection; and an engine control unit generating, in response to said print command, a first control signal when said output signal is not received from said sensing unit, and for generating, in response to said print command, a second control signal when said output signal is received from said sensing unit, said transfer voltage generator applying said first voltage to said transfer roller to transfer said toner image on to said recording medium in response to reception of said first control signal, said transfer voltage generator applying said second voltage to said transfer roller in response to reception of said second control signal.

6. The electrophotographic device of claim 5, comprised of said second voltage being greater than said first voltage.

7. The electrophotographic device of claim 6, comprised of said individual sheets of said recording medium fed through said automatic feed tray being printing paper having a common thickness.

8. The electrophotographic device of claim 7, comprised of said individual sheets of said recording medium fed through said manual feed tray having a thickness that is greater than said common thickness.

9. A method of photocopying on sheets of recording medium having varying thicknesses, comprising:

automatically and sequentially feeding sheets of a first recording medium having a common thickness via a first avenue extending from a source of the first recording medium and onto a path for conveyance through said image forming apparatus;

manually feeding sheets of a second recording medium having varying thicknesses via a second and different avenue into said image forming apparatus and onto said path;

sending a print command to a video controller within said apparatus;

relaying said print command from an video controller to said engine control unit within said apparatus;

allowing each sheet of recording medium introduced into said image forming apparatus via said manual feeding tray to pass along said second avenue and past a sensing unit located along said second avenue and adjacent to said manual feeding tray;

outputting from said sensing unit to said engine control unit a responsive signal in response to the passage of said sheet of recording medium by said sensing unit;

outputting from said engine control unit to a transfer voltage generator a second signal in response to reception of said responsive signal from said sensing unit;

outputting a first bias voltage from said transfer voltage generator to a transfer roller;

changing said first bias voltage to a second and different bias voltage in response to said second signal received from said engine control unit;

producing a latent image of information on a circumferential exterior surface of a photosensitive drum positioned along said path;

producing a toner image corresponding to said latent image on said photosensitive drum with an introduction of toner;

transferring said toner image onto said sheet of recording medium by conveying each sheet of recording medium along said path between said transfer roller and said photosensitive drum;

fixing said toner image to each sheet of recording medium by conveying each sheet of recording medium along said path between heated and pressurized rollers; and discharging each sheet of recording medium containing said image from said image.

10. The method of claim 9, comprised of applying said first voltage to said transfer roller with a magnitude that is greater than the voltage applied to said transfer roller for printing paper having a standard thickness.

11. The method of claim 10, comprising said print command being input manually by a user on a keypad from an operation panel connected to said video controller.

12. The method of claim 10, comprising said print command being input automatically from a host computer connected to said video controller.

13. An electrophotographic device, comprised of:

a plurality of recording medium trays each attachable to a different portion of the device and each separately introducing sheets of recording media via different avenues onto a path of conveyance through the device;

a photosensitive drum having an exterior circumferential surface supporting formation of toner images comprised of toner borne by said exterior circumferential surface;

a transfer roller positioned to transfer said toner images onto the sheets conveyed along the path while biased to a selected one of a plurality of different transfer voltages;

an operating panel enable manual selection of a print command;

a sensor positioned along a first of said avenues, automatically generating an output signal in response to each passage of a sheet of the recording medium along said first of said avenues;

an engine controller selectively generating a first control signal in dependence upon reception of said sensing signal and a second and different control signal in an absence of said reception; and a transfer voltage generator responding to said print command by providing a first one of said transfer voltages to said transfer roller whenever said first control signal is received and providing a second and different one of said transfer voltages to said transfer roller whenever said second control signal is received.

14. An electrophotographic device comprising:

means for manually inserting into said device sheets of recording medium having a larger than a standard thickness via a first avenue leading to a path for conveyance of the sheets of recording medium through said device;

means for automatically feeding into said device recording medium in the form of printing papers having said standard thickness via a second and different avenue leading to said path;

a controller;

means for signaling said controller of said electrophotographic device that a printing operation is about to be performed;

a sensor positioned along said path and automatically responding to passage of a sheet of the recording medium along said first avenue between said manually inserting means and said path by signaling said controller of said electrophotographic device that said recording medium has been manually inserted into said device via said manually inserting means;

controlling means for making adjustments to a transfer voltage based on said signaling received by said controller of said electrophotographic device;

means for printing on sheets of recording medium having a standard thickness and on sheets of recording medium having a larger than standard thickness by operationally responding to said adjustments for transferring an image from a video control unit to a photosensitive drum in said electrophotographic device and then on to said sheets of recording medium;

means for fixing said image onto said sheets of recording medium; and means for discharging said recording medium from said device.

15. The electrophotographic device of claim 14, further comprised of said controlling means setting the magnitude of said transfer voltage to a value greater when said sheets of recording medium are inserted into said electrophotographic device manually than when said printing papers are fed into said electrophotographic device automatically.

16. The electrophotographic device of claim 15, further comprised of an operation panel having a keypad, said means for signaling to said controller of said electrophotographic device that a printing operation is about to be performed is initiated by a manual input from a user via said keypad.

17. The electrophotographic device of claim 15, further comprised of said means for signaling to said controller of said electrophotographic device that a printing operation is about to be performed being responsive to signals generated from a host computer.

18. An image forming apparatus, comprising:

a photosensitive drum positioned to form images upon printable media traveling along a path of conveyance through said apparatus;

a cassette positioned to feed printable media into said path of conveyance via a first subsidiary path;

a manual paper feed tray disposed to introduce printable media into said path of conveyance via a second subsidiary path;

a manual paper feed sensor positioned to automatically sense passage of the printable media along said second subsidiary path and to automatically produce a sensing signal in response to each said passage of the printable media;

an engine controller selectively generating one of a first control signal and a second control signal in dependence upon reception of said sensing signal;

a transfer voltage generator providing a first transfer voltage when said first control signal is received and providing a second transfer voltage when said second control signal is received; and a transfer unit operatively responding to application of one of said first transfer voltage and said second transfer voltage provided by said transfer voltage generator, by transferring images formed on said photosensitive drum, onto the printable media traveling along said path.

* * * * *